US011371198B2

(12) United States Patent
Gallagher et al.

(10) Patent No.: US 11,371,198 B2
(45) Date of Patent: Jun. 28, 2022

(54) SPACER PIECE FOR A GUARD RAIL SYSTEM

(71) Applicant: Industrial Galvanizers Corporation Pty Ltd., Minto (AU)

(72) Inventors: Luke Gallagher, Cronulla (AU); Vitor Valentim Becker, Maroubra (AU)

(73) Assignee: Industrial Galvanizers Corporation Pty Ltd, Minto (AU)

( * ) Notice: Subject to any disclaimer, the term of this patent is extended or adjusted under 35 U.S.C. 154(b) by 177 days.

(21) Appl. No.: 16/517,819

(22) Filed: Jul. 22, 2019

(65) Prior Publication Data

US 2020/0032468 A1 Jan. 30, 2020

(30) Foreign Application Priority Data

Jul. 26, 2018 (AU) ..... 2018902712

(51) Int. Cl.
*E01F 15/04* (2006.01)

(52) U.S. Cl.
CPC ..... *E01F 15/0438* (2013.01); *E01F 15/0423* (2013.01); *E01F 15/0461* (2013.01)

(58) Field of Classification Search
CPC ..... E01F 15/0407; E01F 15/0423; E01F 15/0438; E01F 15/0461; E01F 15/0484
See application file for complete search history.

(56) References Cited

U.S. PATENT DOCUMENTS

| | | | | |
|---|---|---|---|---|
| 319,277 A | | 6/1885 | Lesher | |
| 2,025,014 A | | 12/1935 | Brickman et al. | |
| 2,317,249 A | | 4/1943 | Brickman | |
| 2,520,313 A | | 8/1950 | Harris | |
| 3,214,142 A | | 10/1965 | Brown et al. | |
| 3,353,795 A | | 11/1967 | Muller | |
| 3,388,892 A | | 6/1968 | Case | |
| 3,468,574 A | | 9/1969 | Schell, Jr. | |
| 3,493,213 A | * | 2/1970 | Ackerman | E01F 15/0438 256/13.1 |
| 3,617,076 A | | 11/1971 | Attwood | |
| 3,981,486 A | | 9/1976 | Baumann | |
| 3,982,735 A | | 9/1976 | Fornells | |
| 4,158,998 A | | 6/1979 | Clement | |
| 4,759,161 A | | 7/1988 | Kucyk, Jr. et al. | |
| 5,125,194 A | | 6/1992 | Granger | |
| 5,152,507 A | | 10/1992 | Lee | |

(Continued)

FOREIGN PATENT DOCUMENTS

| | | |
|---|---|---|
| AU | 2012262645 B2 | 9/2015 |
| DE | 3640821 C1 | 3/1988 |

(Continued)

OTHER PUBLICATIONS

European Patent Office Espacenet, English abstract of DE3640821 (C1), printed on Jun. 28, 2018.

(Continued)

*Primary Examiner* — Jonathan P Masinick

(74) *Attorney, Agent, or Firm* — Cahn & Samuels, LLP

(57) ABSTRACT

The present invention provides a spacer piece for securing a guardrail beam to a support post in a guardrail system, the spacer piece including a breakable portion configured to break preferentially during an impact, and release the beam from the support post.

15 Claims, 20 Drawing Sheets

(56) References Cited

U.S. PATENT DOCUMENTS 5,172,891 A 12/1992 Chen
5,188,342 A 2/1993 Oullette et al.
5,195,727 A 3/1993 Liao et al.
5,219,241 A 6/1993 Picton
5,297,890 A 3/1994 Commins
5,429,449 A 7/1995 Baatz
5,657,966 A 8/1997 Cicinnati
5,660,375 A 8/1997 Freeman
6,007,269 A 12/1999 Marinelli
6,036,399 A 3/2000 Schalk
6,168,346 B1 * 1/2001 Ernsberger ..... E01F 15/0438 256/13.1
6,220,576 B1 4/2001 Chan
6,301,846 B1 10/2001 Waalkes et al.
6,308,936 B1 10/2001 Atwood
6,502,805 B2 1/2003 Lewis et al.
6,516,573 B1 2/2003 Farrell et al.
6,530,560 B2 * 3/2003 King ..... E01F 15/0438 256/1
6,575,656 B2 6/2003 Suh
6,644,888 B2 11/2003 Ochoa
D501,934 S * 2/2005 Mushett ..... D25/118
6,962,328 B2 11/2005 Bergendahl
7,229,050 B2 6/2007 Schloss
7,234,687 B2 * 6/2007 King ..... E01F 15/0438 256/13.1
7,445,402 B1 11/2008 Chen
7,478,796 B2 1/2009 Burkett
7,530,548 B2 5/2009 Ochoa
7,699,293 B2 4/2010 James
7,731,159 B2 6/2010 Pericas
7,832,713 B2 * 11/2010 King ..... E01F 15/0438 256/13.1
7,850,317 B2 * 12/2010 Blackburn ..... E01F 9/669 359/552
7,980,519 B2 7/2011 Chen
7,997,824 B2 8/2011 Pericas
8,353,499 B2 1/2013 Conway et al.
8,858,112 B2 * 10/2014 Wallace ..... E01F 15/0461 404/6
9,631,331 B2 4/2017 Colquhoun et al.
D913,775 S * 3/2021 Gallagher ..... D8/354
2001/0048846 A1 12/2001 Ochoa
2002/0053664 A1 5/2002 Moore
2004/0234334 A1 11/2004 King
2005/0242334 A1 * 11/2005 King ..... E01F 15/0438 256/13.1
2005/0269558 A1 12/2005 Keefe
2007/0003361 A1 1/2007 Wang
2007/0098489 A1 * 5/2007 Demozzi ..... E01F 15/0438 404/6
2007/0245681 A1 10/2007 Patton
2008/0224114 A1 9/2008 Cheng
2009/0050863 A1 2/2009 Conway et al.
2009/0050864 A1 2/2009 Conway et al.
2009/0206308 A1 8/2009 Pericas
2010/0008722 A1 * 1/2010 Amengual Pericas ..... E01F 15/0438 404/6
2010/0126106 A1 5/2010 Ivarsson
2011/0095250 A1 4/2011 Barrier
2012/0003039 A1 1/2012 Wallace et al.
2014/0050524 A1 * 2/2014 Kulkarni ..... E01F 15/043 404/6

FOREIGN PATENT DOCUMENTS

DE 202012102548 U1 * 9/2012 ..... E01F 15/0438
EP 0307796 A1 3/1989
EP 0452205 A2 * 10/1991 ..... E01F 15/0438
EP 0554864 A1 8/1993
EP 0708206 A1 4/1996
EP 1650351 B1 10/2005
EP 1780339 A1 * 5/2007 ..... E01F 15/0423
EP 1813725 A1 8/2007
EP 1876300 A1 * 1/2008 ..... E01F 15/0423
EP 1857594 B1 6/2010
EP 2383390 A2 * 11/2011 ..... E01F 15/0438
FR 1435043 A * 4/1966 ..... B62D 29/04
FR 1570598 6/1969
FR 2660677 A1 * 10/1991 ..... E01F 15/0438
GB 2397604 A 7/2004
JP 2791288 B2 8/1998
JP 2008128487 A 6/2008
KR 200300015 Y1 1/2003
KR 200316380 Y1 6/2003
KR 200341426 Y1 2/2004
KR 20060073218 A 6/2006
KR 1020080109207 A 12/2008
WO 94/03678 A1 2/1994
WO 2007079520 A1 7/2007
WO 2009025997 A2 2/2009
WO 2010105307 A1 9/2010
WO 2011000127 A1 1/2011

OTHER PUBLICATIONS

European Patent Office Espacenet, English abstract of EP1650351 (A2), printed on Jul. 10, 2018.
European Patent Office Espacenet, English abstract of EP1857594 (A1), printed on Jul. 10, 2018.
European Patent Office Espacenet, English abstract of EP0307796 (A1), printed on Aug. 28, 2012.
European Patent Office Espacenet, English abstract of EP0554864 (A1), printed on Aug. 28, 2012.

* cited by examiner

SPACER PIECE FOR A GUARD RAIL SYSTEM

I. FIELD OF THE INVENTION

The present invention relates to improved spacer pieces for securing a guard rail beam to a support post in a guard rail system.

II. BACKGROUND OF THE INVENTION

Conventional guard rail systems typically include a guardrail beam supported by a plurality of support posts positioned along a roadway. In such systems, it is common to use a spacer or blocking piece to offset the guard rail beam from the support posts. Spacer/blocking pieces help to prevent snagging of vehicle wheels during the early stages of an impact.

Any reference herein to known prior art does not, unless the contrary indication appears, constitute an admission that such prior art is commonly known by those skilled in the art to which the invention relates, at the priority date of this application.

III. SUMMARY OF THE INVENTION

The present invention seeks to provide an improved spacer/blocking piece for a guard rail system.

The present invention provides a spacer piece for securing a guardrail beam to a support post in a guardrail system, the spacer piece including a breakable portion configured to break preferentially during an impact, and release the beam from the support post.

The spacer piece can be configured to mount the guardrail beam at the breakable portion.

The spacer piece can be configured to be mounted to the support post at a portion thereof that is not the breakable portion.

An upper portion and a lower portion can be separated by the breakable portion, the upper and lower portion being configured to be mounted to the support post.

The breakable portion can be provided as all or part of a narrowed neck between the upper portion and the lower portion.

The spacer piece can include a guardrail mounting plane and a support post mounting plane, the breakable portion only extending partway from the guardrail mounting plane the support post mounting plane.

The spacer piece can include opposing outer side walls that extend from a guardrail mounting side of the spacer piece to a support post mounting side.

The outer walls at the breakable portion can be thinner than at the upper and lower portions or the spacer.

The outer walls of the breakable portion can include apertures therein.

The breakable portion can include at least one internal wall, the internal wall(s) including apertures therein.

The spacer piece can be configured to permit more than one mounting position or orientation on the support post.

The upper and lower portions can each include multiple channels therein, for selectively receiving fastening elements, the selective positioning of fastening elements permitting more than one mounting position or orientation on the support post.

The upper and lower portions, at the support post mounting side, include laterally extending angled guide flanges.

At the support post mounting side, a hook portion can project from the topside of the upper portion.

At the guardrail mounting side, a lip tab can project from the underside of the lower portion.

The present invention also provides a guardrail system including: a guardrail beam; at least one support post; and spacer piece as described above in this section.

It will be appreciated that spacer pieces as described herein may also be referred to by persons skilled in the art as blocking pieces, block out pieces or offset pieces. For the purposes of simplicity, the term "spacer piece" shall be used predominantly throughout the specification, however, it will be appreciated by a person skilled in the art that above noted terms would be readily interchangeable.

IV. BRIEF DESCRIPTION OF THE DRAWINGS

A detailed description of embodiments of the invention will follow, by way of example only, with reference to the accompanying drawings.

V. DETAILED DESCRIPTION OF THE EMBODIMENT OR EMBODIMENTS

Figure 1A:
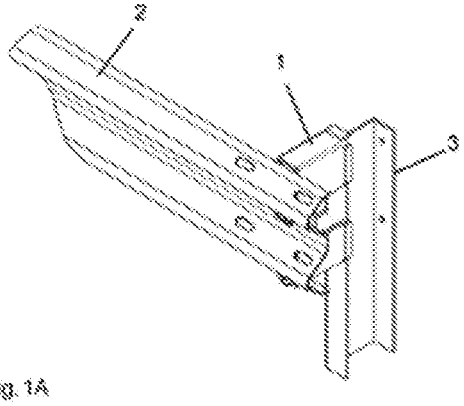
FIGS. 1A and 1B are perspective views of a spacer piece according to one embodiment of the invention, showing the spacer piece mounting a guard rail beam to posts at different heights above ground.
Figure 1B:
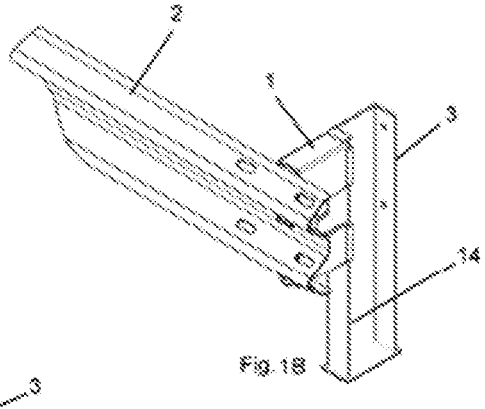
Figure 2:
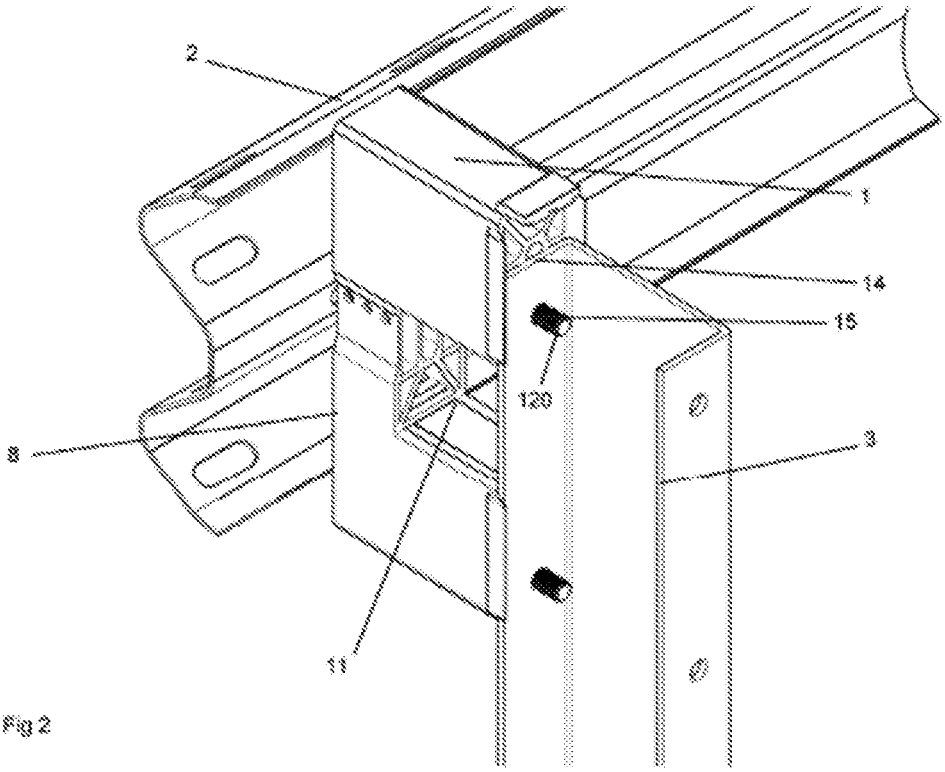
FIG. 2 is enlarged view of FIG. 1A.

Embodiments of the invention provide a spacer piece for securing a guardrail beam to a support post in a guardrail system. The spacer piece includes a breakable portion configured to break preferentially during an impact, and release the beam from the support post.

Generally, the spacer piece is configured so as to mount the guardrail beam at the breakable portion. For example, a fastening element, such as bolt or the like, would typically be received through the guard rail and into the breakable portion of the spacer piece. During a vehicle impact, the breakable portion ruptures preferentially, and the guard rail beam is released from the support post. It will be appreciated in some instances of impact, part of the breakable portion may maintain the fastening element/bolt, but may separate (together with the bolt) from the remainder of the spacer piece to thereby release the guard rail from the support post. In other instances of impact, the fastening element/bolt may simply be released from the breakable portion as it ruptures, releasing the guard rail from the support post.

In alternate forms, the breakable portion may form part of another area in the spacer piece, i.e. other than the guard rail mounting area. For example, in alternate forms, the breakable portion may form part of the support post mounting area, or may be situated in the spacer piece away from the mounting locations of the guardrail beam and support post.

Generally though, the spacer piece is configured to be mounted to the support post at a portion thereof that is not the breakable portion. This provides that, after rupturing of the breakable portion, the majority of the spacer piece is maintained at the support post. This reduces debris and pollution to the surrounding environment after a vehicle impact.

The spacer pieces as described herein typically include an upper portion and a lower portion separated by the breakable portion. It is the upper and lower portions that are typically configured to be mounted to the support post, whilst the breakable portion is typically configured to mount the guard rail beam.

The breakable portion may be provided as all or part of a narrowed neck between the upper portion and the lower portion. In one example, the spacer piece may resemble a substantially "C" or rotated "U" block shape. In the context of the guardrail mounting plane and the support post mounting plane of the spacer piece, the breakable portion typically only extends partway from the guardrail mounting plane to the support post mounting plane. This provides that, once mounted to the support post, a cut out space is provided between the breakable portion and the support post. The cut out space can facilitate mounting of the guard rail beam, for example, by providing easier access to fasten an element/bolt at the support post mounting side of the breakable portion.

The spacer piece typically includes opposing outer side walls that extend from a guardrail mounting side of the spacer piece to a support post mounting side. In one example, to facilitate rupture of the breakable portion, the outer walls at the breakable portion are thinner than at the upper and lower portions of the spacer piece. Alternatively or additionally, to increase the breakability of the breakable portion, the outer walls of the breakable portion may also include apertures or cut outs therein.

The spacer piece may have internal walls to increase the strength thereof. In the breakable portion, any internal wall(s) would typically also include apertures or cut-outs therein to facilitate rupture/increase breakability.

The spacer piece may also be configured to permit more than one mounting position or mounting orientation on the support post. Different mounting positions/orientations on the support post may, for example, allow a guard rail beam to be secured to the support post(s) at different heights. In one example, to allow more than one mounting position on a support post, the upper and lower portions each include multiple channels therein, for selectively receiving fastening elements, the selective positioning of fastening elements permitting more than one mounting position on a support post.

The upper and lower portions, at the support post mounting side, may also include laterally extending angled guide flanges to assist with placement of the spacer piece during installation to a support post. The flanges helping to align the spacer piece to a support post before fastening.

To additionally assist during installation, the spacer piece, at the support post mounting side, may include a hook portion that projects from the top of the upper portion. The hook portion, in some instances, permitting the support piece to be hung off a flange of the support post. Furthermore, at the guardrail mounting side, a lip tab that projects from the bottom of the lower portion may also be included. During installation, a guard rail beam may be rested on the lip tab.

It will be appreciated that whilst, according to one aspect, the present invention relates to a spacer piece, in another aspect, the present invention relates to a guard rail system that implements the spacer piece. Typically such a system would include a guard rail beam, at least one support post and at least one spacer piece as described herein.

One embodiment of the spacer piece and guard rail system incorporating same is shown in FIGS. 1A to 12. FIGS. 1A to 3B show a guard rail system including a spacer piece (1) between guard rail beam (2) and support post (3). FIGS. 4 to 12 show the spacer piece (1) in more detail.

The spacer piece (1) has a substantially "C" or rotated "U" block shape wherein upper (4) and lower (5) portions are separated by a narrowed neck portion (6). A breakable portion (7) is provided as part of the narrowed neck portion (6).

Rupture at the breakable portion (7) is facilitated or encouraged by several aspects of the construction of the spacer piece (1). Firstly, the outer walls (8) of the breakable portion (7) are thinned when compared to the outer walls (9) of the remainder of the spacer piece (1). Secondly, apertures (10) are included in the outer walls (9) of the breakable portion (7). Thirdly, as noted above, the breakable potion (7) is provided as part of a narrow neck (6) between the upper (4) and lower (5) portions. In particular, as most clearly shown in FIGS. 5 and 6, the narrowed neck (6) including breakable portion (7) only extends partway from the guardrail mounting plane (A) to the support post mounting plane (B). A cut out space (11) is thereby provided between the narrowed neck (6) and support post when the spacer piece is mounted thereto (see for example FIGS. 5 and 6).

In addition, open channels/grooves (17, 18) are provided at the underside of the upper portion (4) and the topside of the lower portion (5). The open channels/grooves (17, 18) extend from the support post mounting side of the spacer pieces to the guard rail mounting side which provides that the narrow neck (6) is only connected to the upper and lower portions (4, 5) at the rims (17*a*, 18*a*) of the channels (17, 18). This provide a further mechanism for release of the guard rail beam as there is a limited connection area between the narrow neck (6) and upper/lower portions (4, 5) that provides a further preferred rupture/tearing/separation area.

Apart from the narrowed neck (6) facilitating rupturing, having the cut out space (11) provides advantages during installation of the guard rail system. In particular, the cut out space (11) provides access (from the support post mounting side of the spacer piece) to fastening/mounting bolts that secure the guardrail beam (2) to the breakable portion (7).

The spacer piece (1) also has additional features which facilitate installation of a guard rail system. The upper (4) and lower (5) portions include laterally extending angled lead-in flanges (12) which help to align and guide the spacer piece (1) into position on the support post (3). Furthermore, a projecting hook portion (13) extends from the topside of the upper portion (4) of the spacer piece (1) at the support post mounting side to allow, in some instances, the spacer piece (1) to be hung off a flange (14) of a support post (3) such that an installer does not need to hold the spacer piece in place during securement (e.g. during tightening of bolts (120)).

In addition, to facilitate mounting of the guard rail beam (2), a lip tab (16) projects from underside of the lower portion (5) of the spacer piece (1) at the guard rail mounting side. A guard rail beam (2), during installation, may thus be rested on the lip tab (16), to assist the installer.

As shown most clearly in FIGS. 1A to 3B, the spacer piece (1) is configured to allow more than one mounting position on a support post (3) (see, for example, comparison between FIGS. 1A and 1B, 3A and 3B). To allow for this, the upper and lower portions (4, 5) each include two vertically spaced channels (20*a*, 20*b*, 21*a*, 21*b*) therethrough, that extend from the support post mounting side to the guard rail mounting side of the spacer piece (1), the channels being configured to received post mounting bolts (120). It will be appreciated that by selecting different pairs of channels (e.g. 20*a* and 21*a*, or 20*b* and 21*b*) for the fastening bolts (120), the mounting height of the support piece (1) may be selected or adjusted. As such, the height of the guard rail beam (2) may be adjusted with respect to the support post.

Figure 3A:
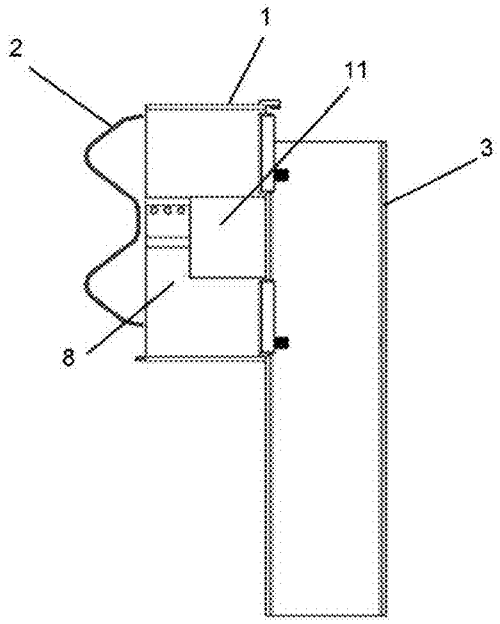
FIG. 3A is a side view of the assembly of FIG. 1A.
Figure 3B:
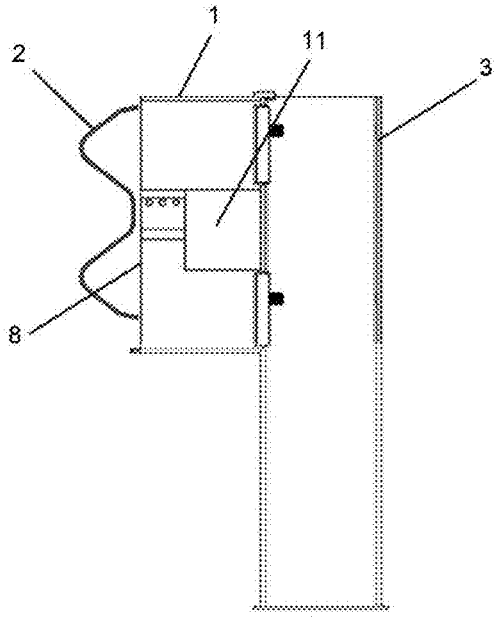
FIG. 3B is a side view of the assembly of FIG. 1B.
Figure 4:
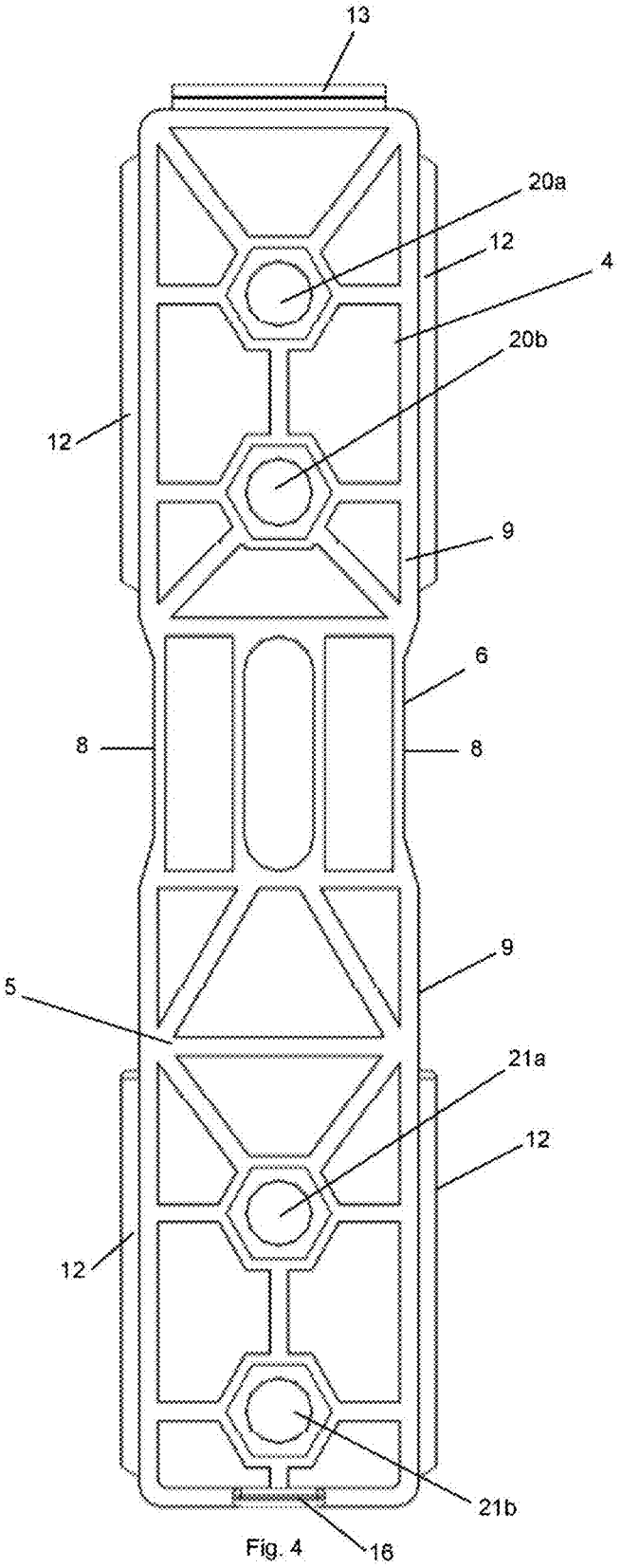
FIG. 4 is a front view of the spacer piece of previous figures.
Figure 5:
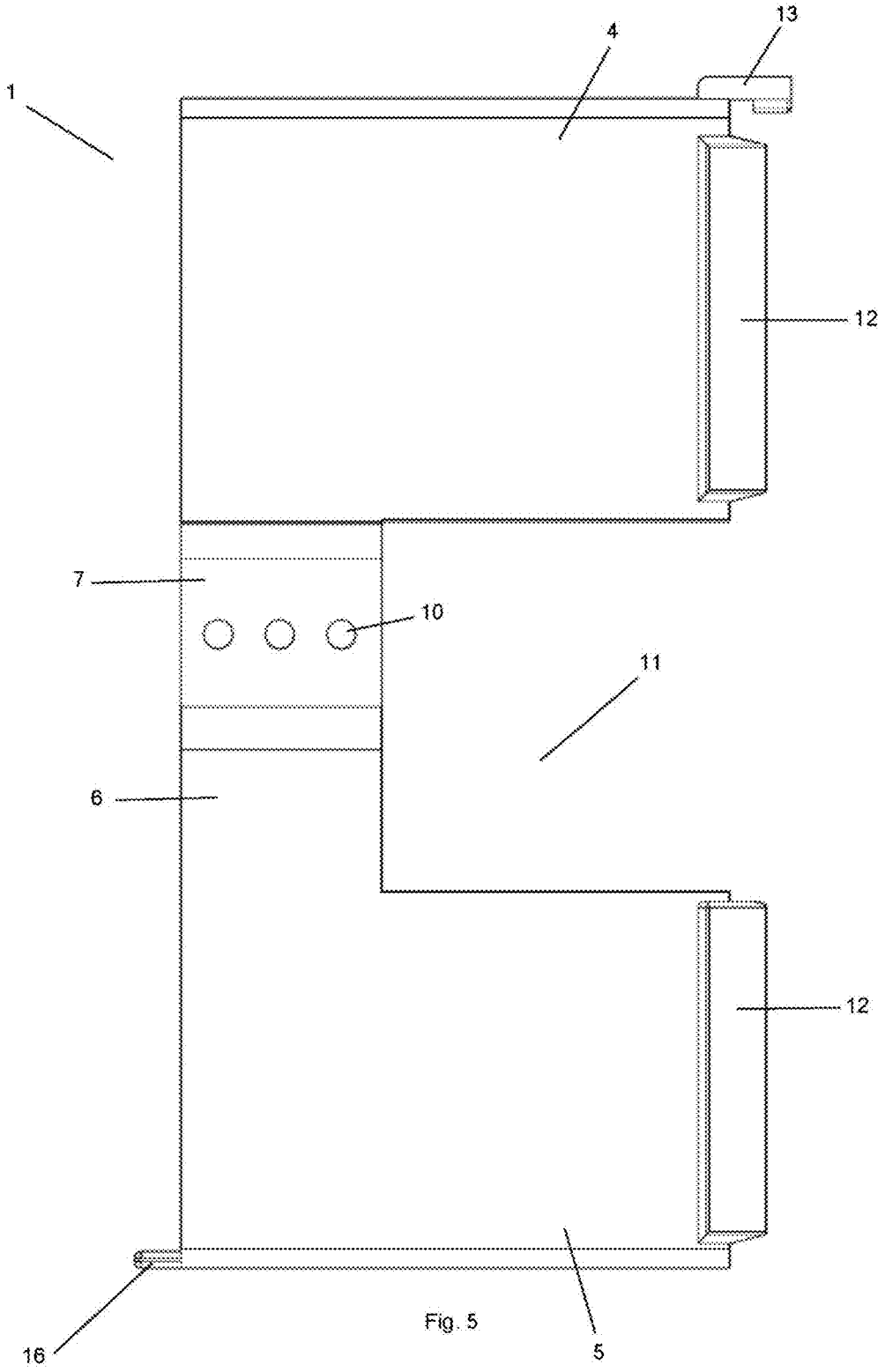
FIG. 5 is a right side view of the spacer of FIG. 4.
Figure 6:
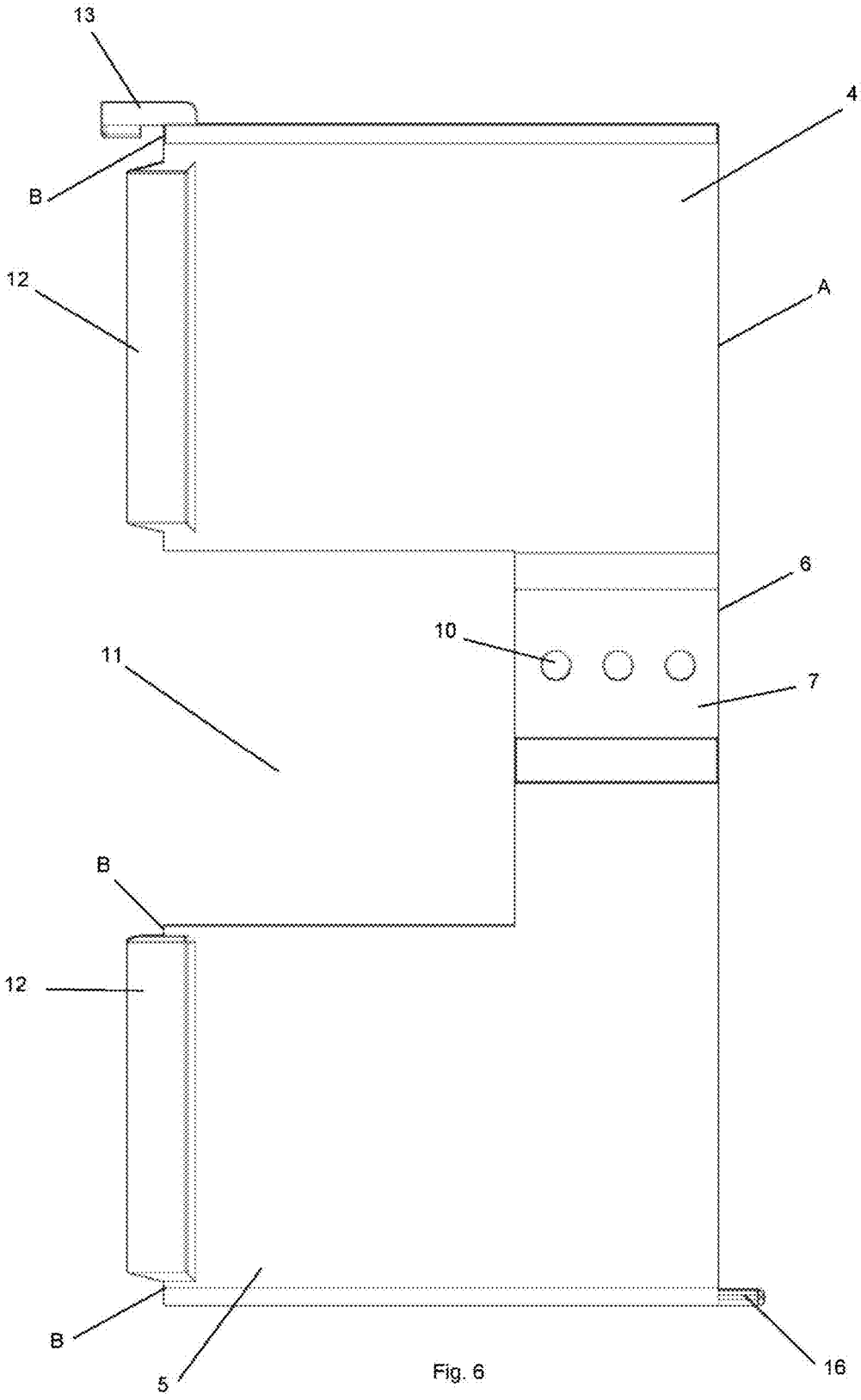
FIG. 6 is a left side view of the spacer of FIG. 4.
Figure 7:
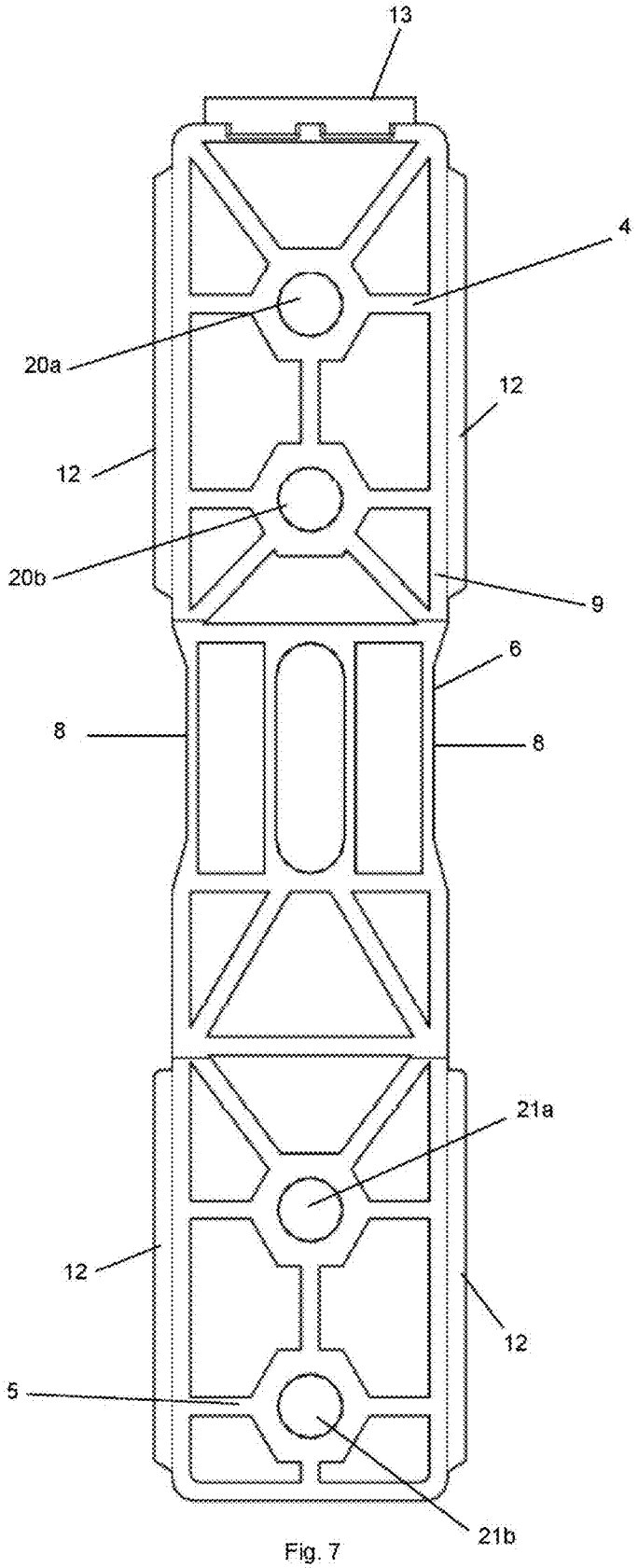
FIG. 7 is a rear view of the spacer piece of FIG. 4.
Figure 8:
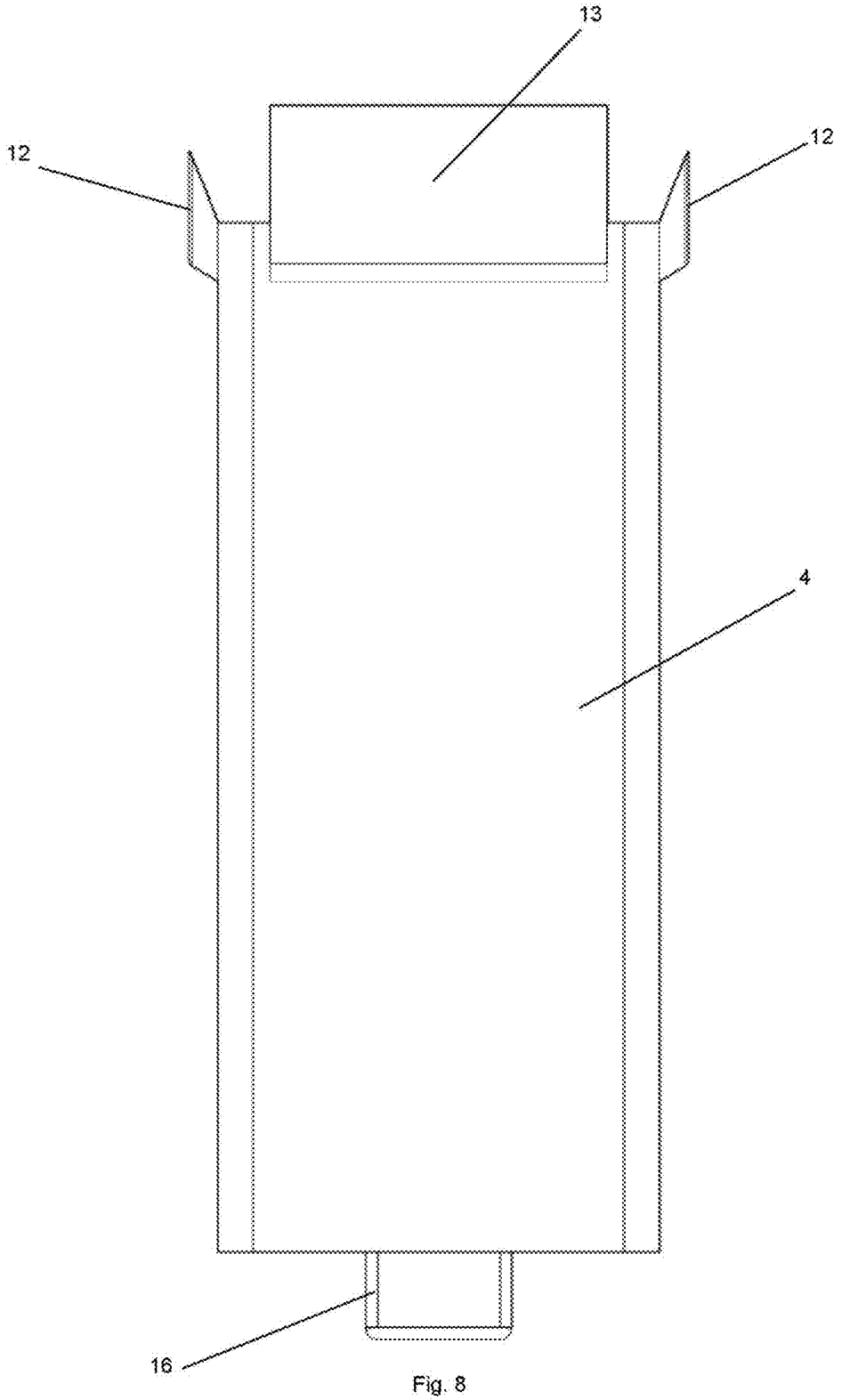
FIG. 8 is an enlarged top view of the spacer piece of FIG. 4.
Figure 9:
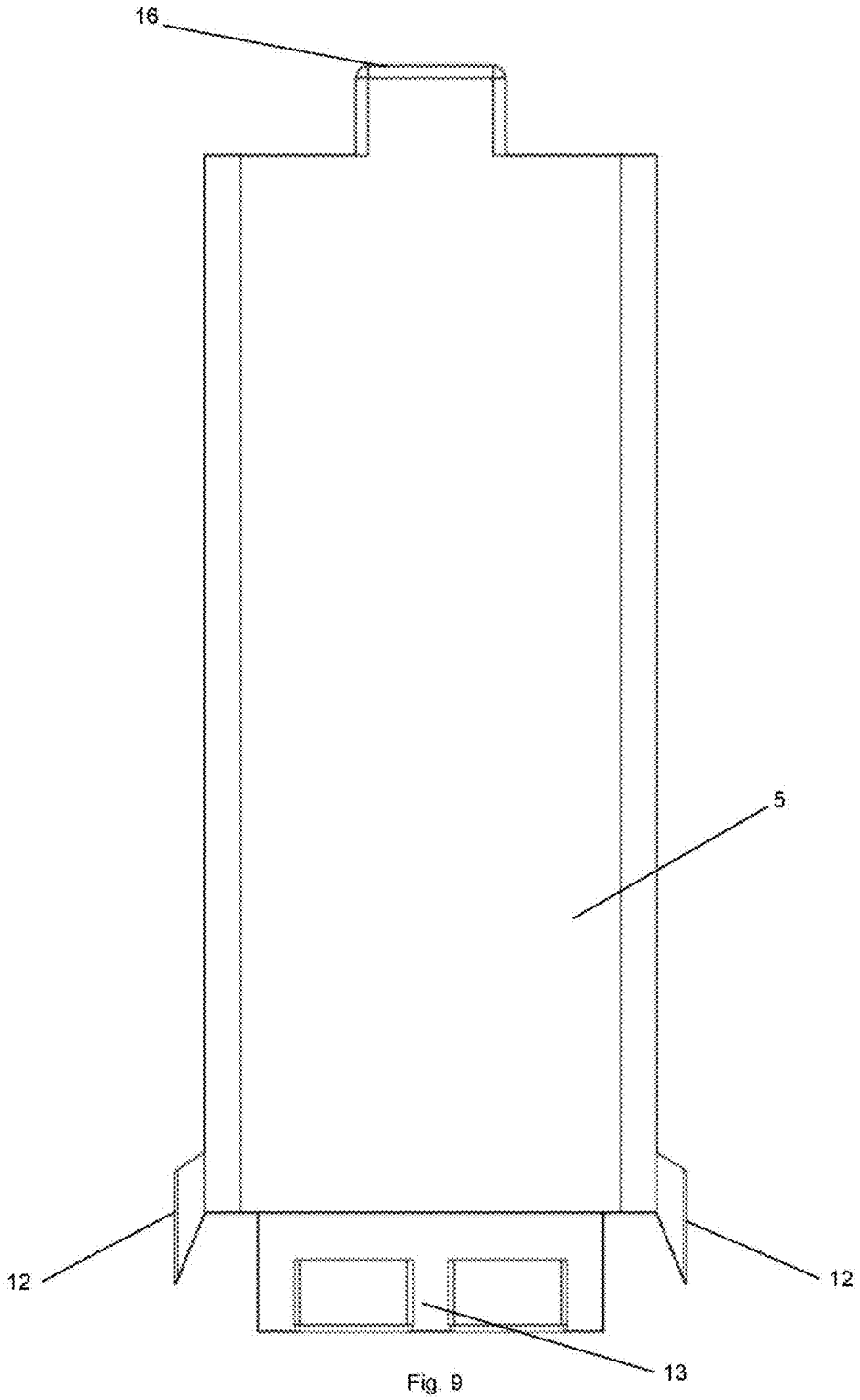
FIG. 9 is an enlarged bottom view of the spacer piece of FIG. 4.
Figure 10:
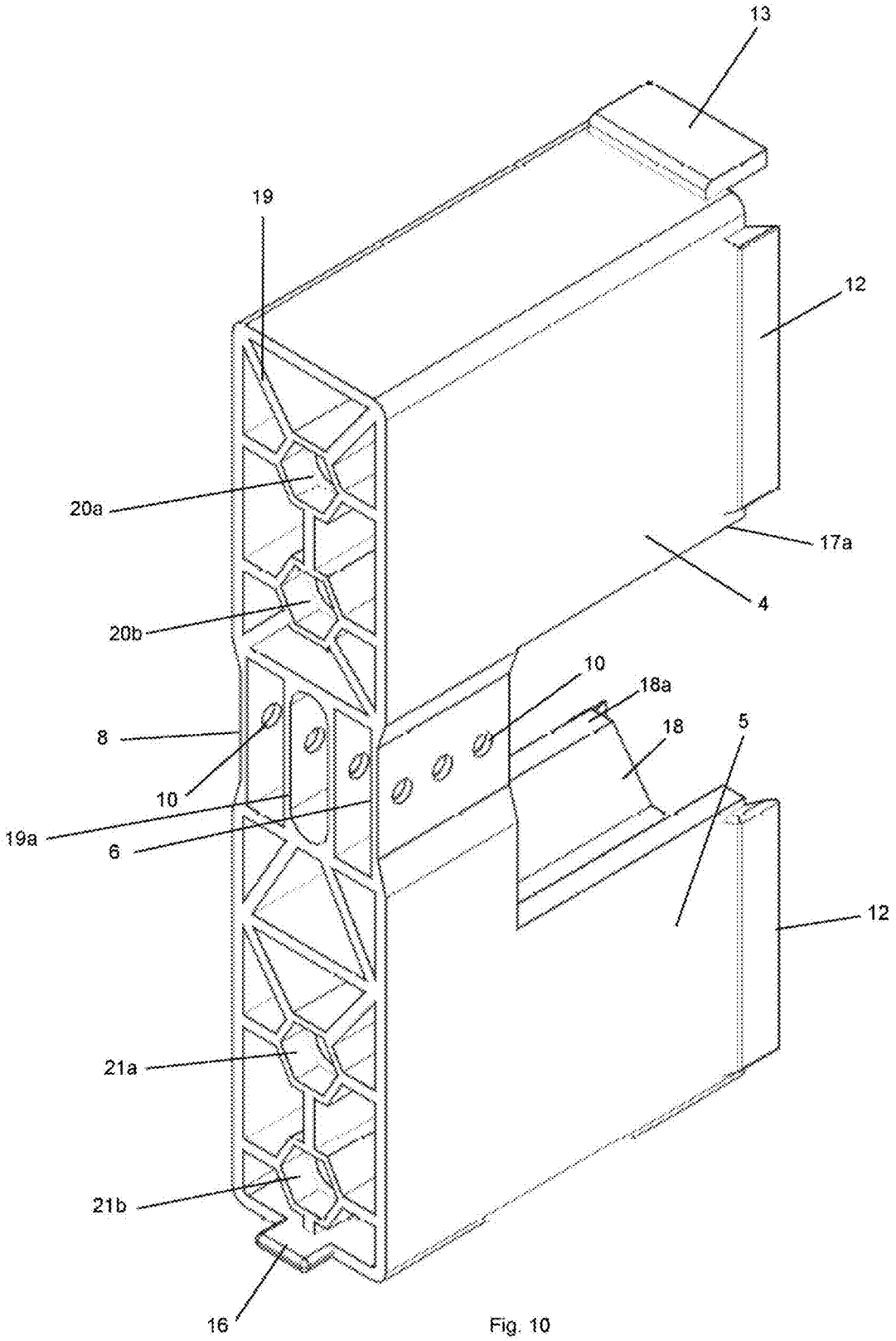
FIG. 10 is a front perspective view of the spacer piece of FIGS. 4 to 9.
Figure 11:
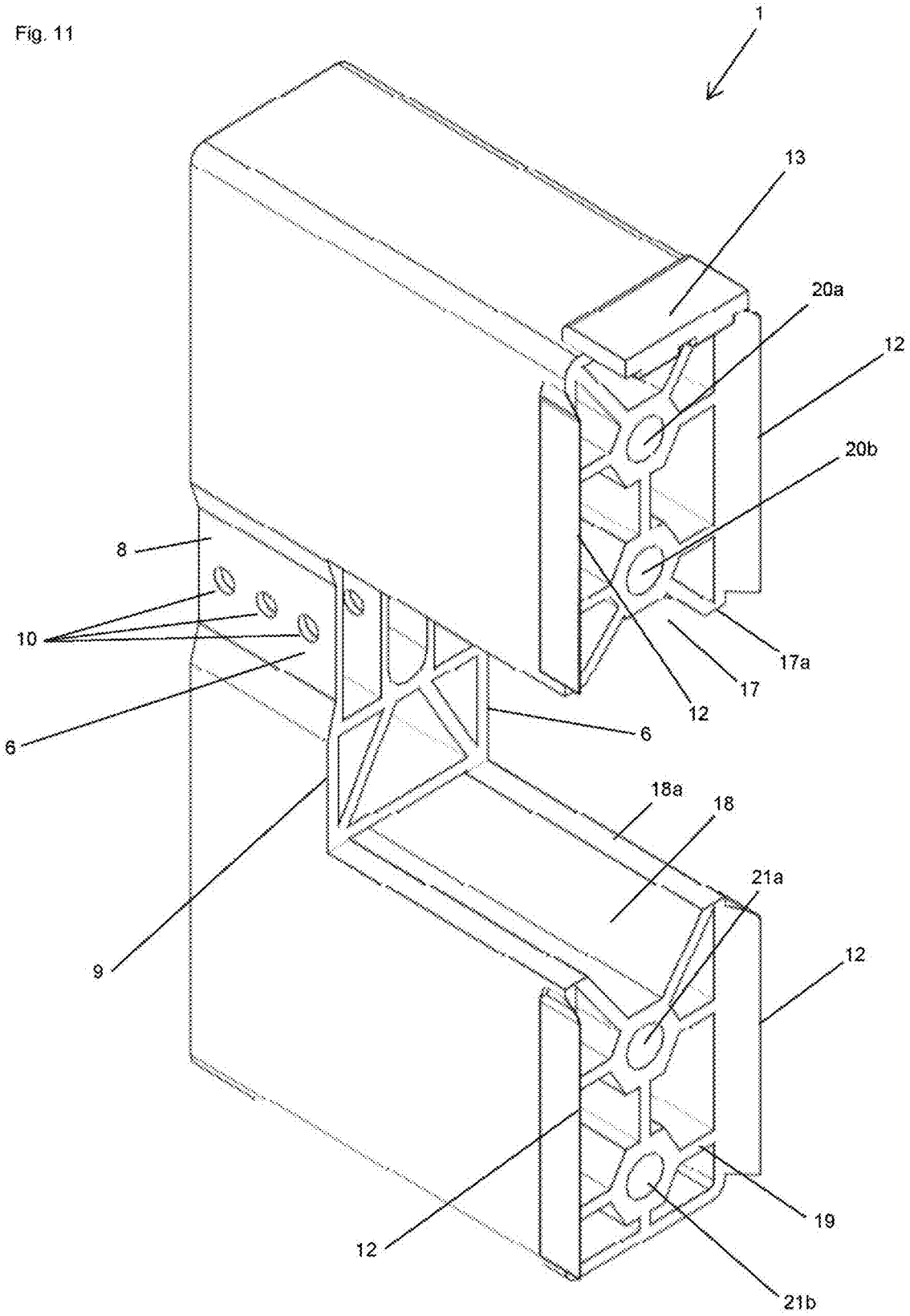
FIG. 11 is a rear perspective view of the spacer piece of FIGS. 4 to 10.
Figure 12:
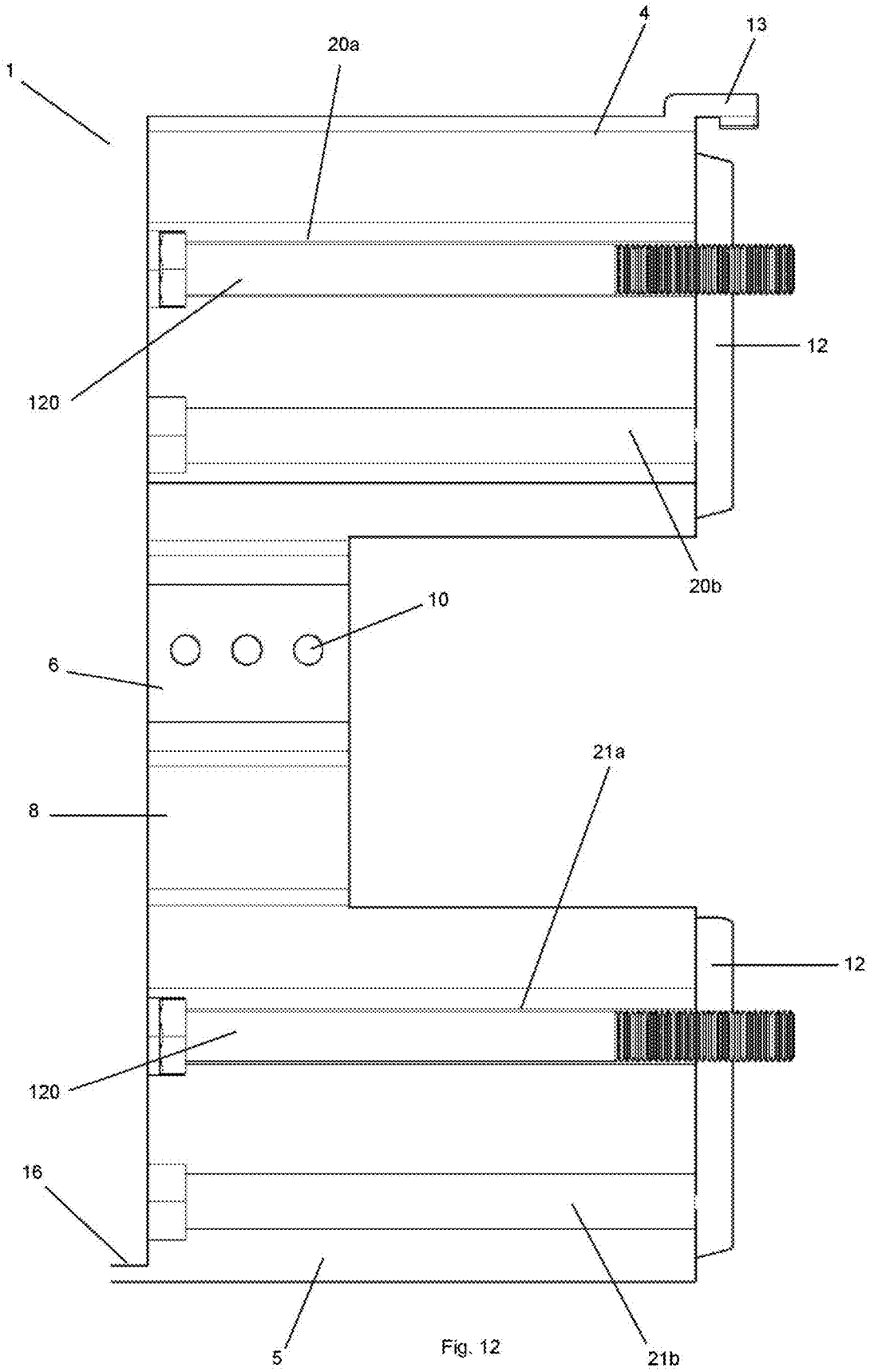
FIG. 12 is a cross-sectional right side view of the spacer piece of FIGS. 4 to 11 showing post mounting bolts inserted therein.

For example, by selecting the respective upper channels (20*a*, 21*a*) of the upper and lower portions (4, 5) of the support piece (1) (e.g. as shown in FIGS. 3B and 12) a relatively lower mounting height may be achieved, whilst by selecting the respective lower channels (20*b*, 21*b*) a relatively higher mounting position may be achieved (as in FIGS. 1A and 3B). This functionality permits that, when using support posts that are too low (such as, for example, that may not meet regulation guard rail height) the guard rail (2) can be elevated by the spacer piece (1) to compensate.

At the guard rail mounting side, the channels (20, 21) widen into hexagonal recesses that permit the heads of the mounting bolts (120) to be received therein. This provides that once the spacer piece (1) is secured to a support post, the mounting bolts do not protrude from the spacer at the guard rail mounting side. This is advantageous in that the heads of the bolts do not interfere with mounting of the guard rail beam.

Figure 13:
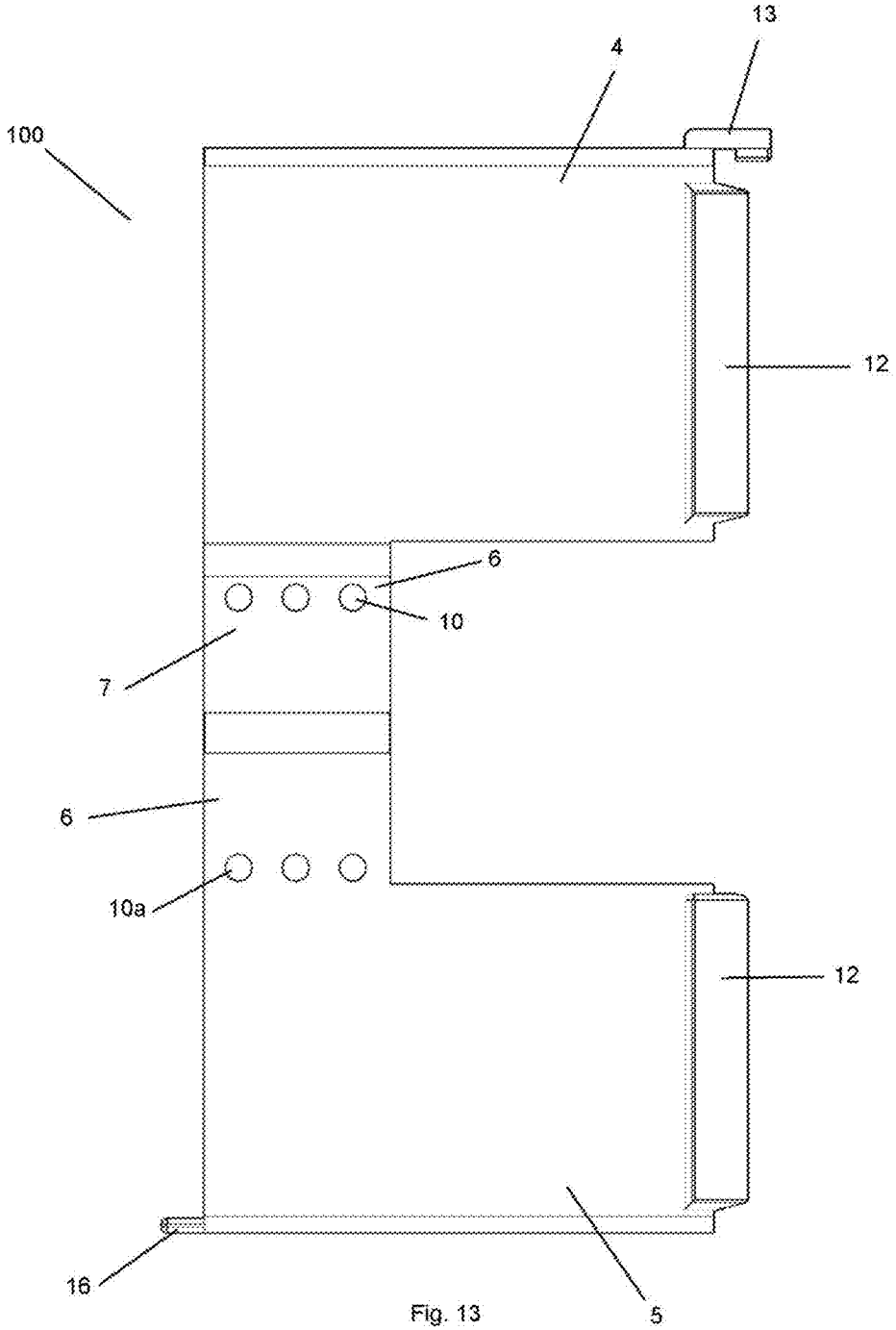
FIG. 13 is a right side view of a second embodiment of spacer piece according to the invention.
Figure 14:
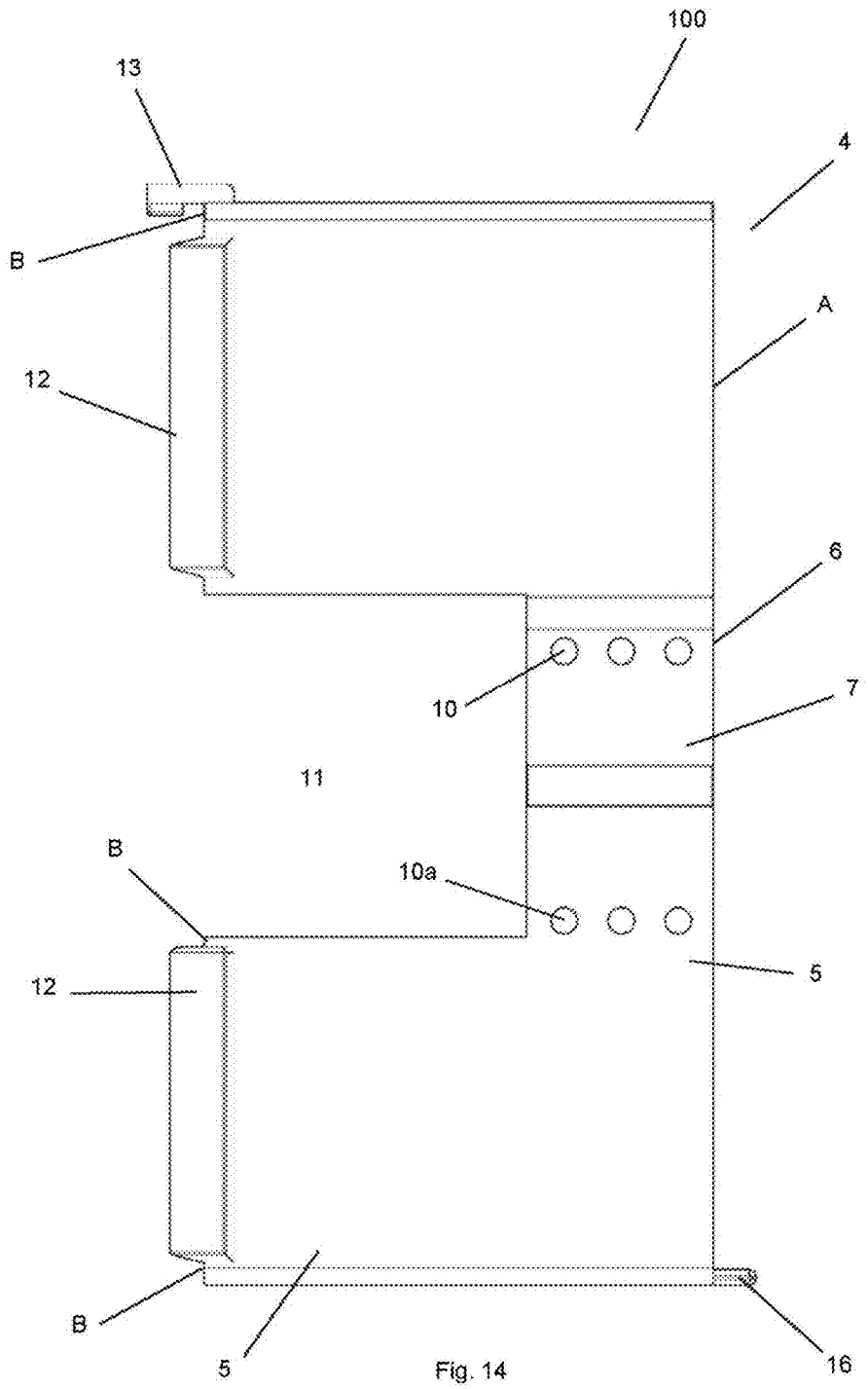
FIG. 14 is a left side view of the spacer piece of FIG. 13.
Figure 15:
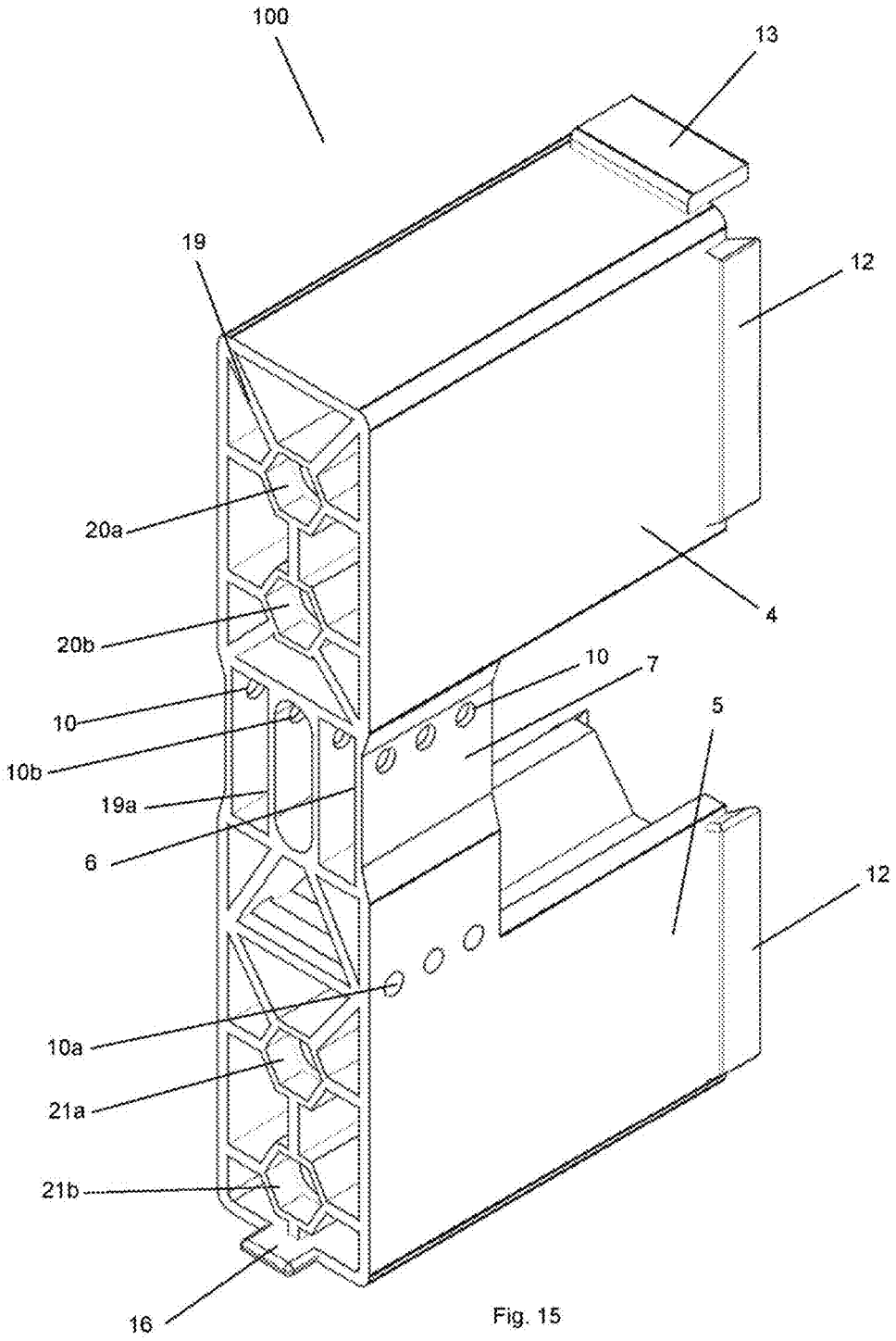
FIG. 15 is a front perspective view of the spacer piece of FIG. 13.
Figure 16:
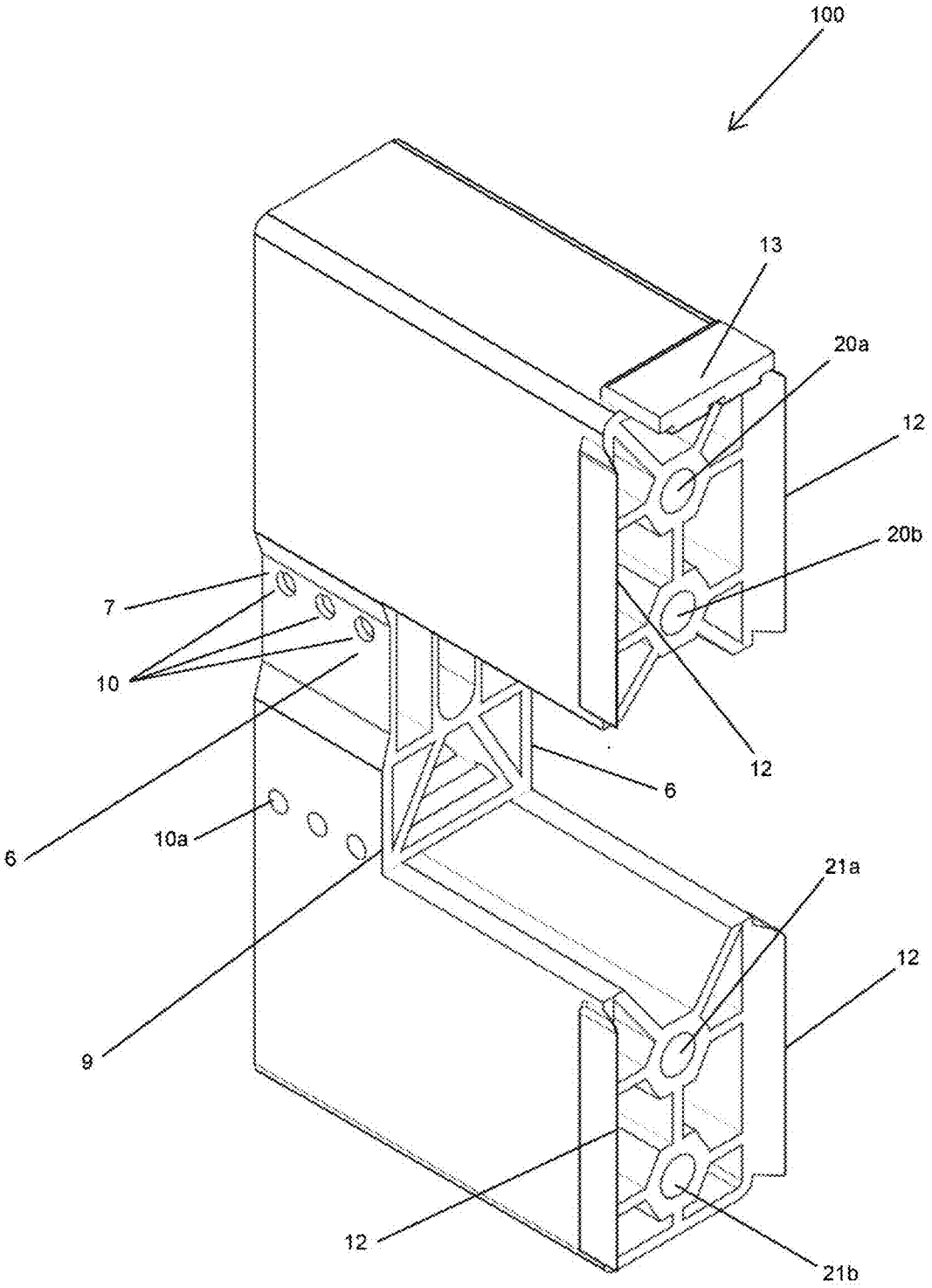
FIG. 16 is a rear perspective view of the spacer piece of FIG. 13.
Figure 17:
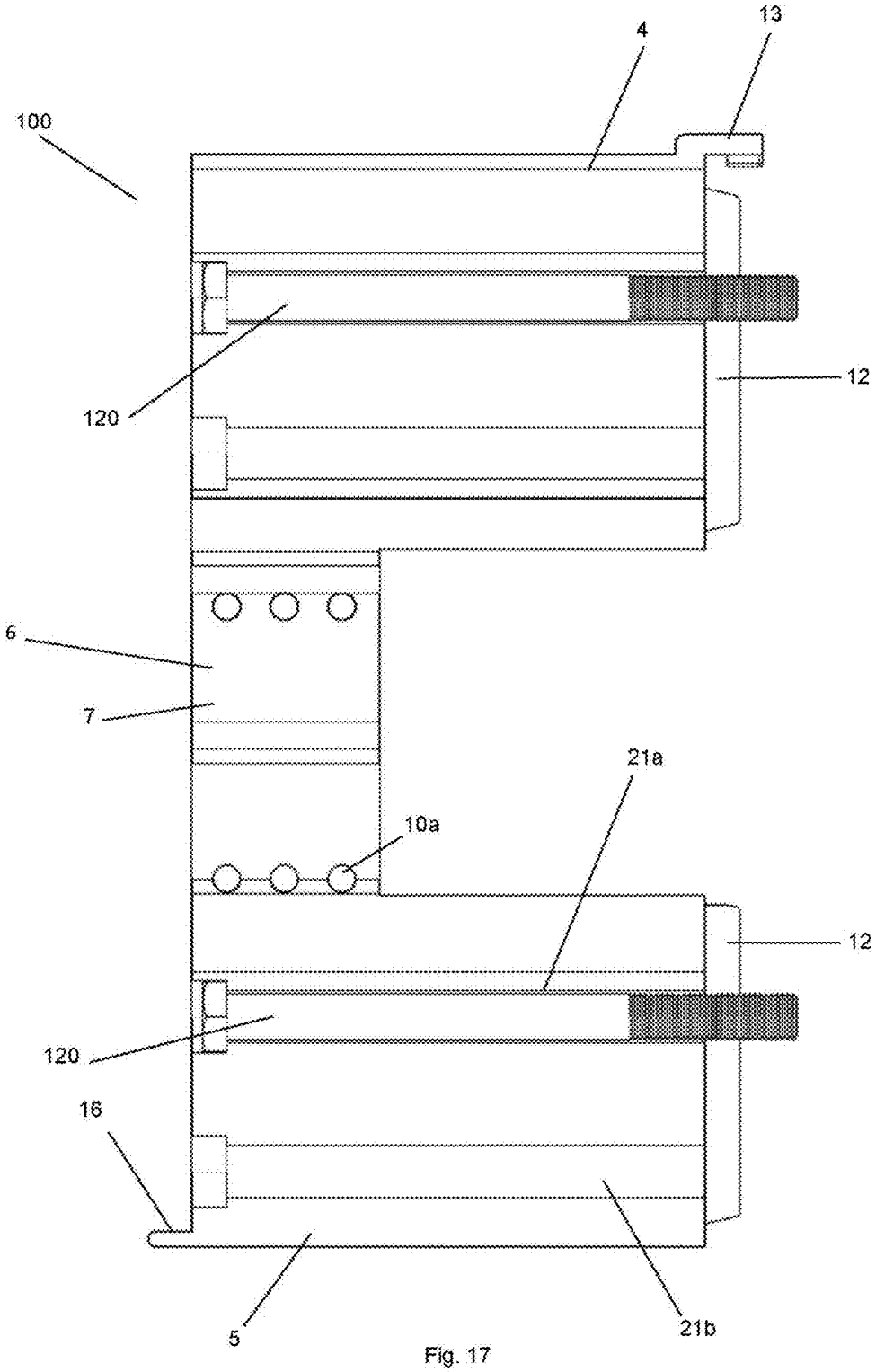
FIG. 17 is a cross sectional view of the spacer piece of FIGS. 13 to 16 showing post mounting bolts inserted therein.
Figure 18:
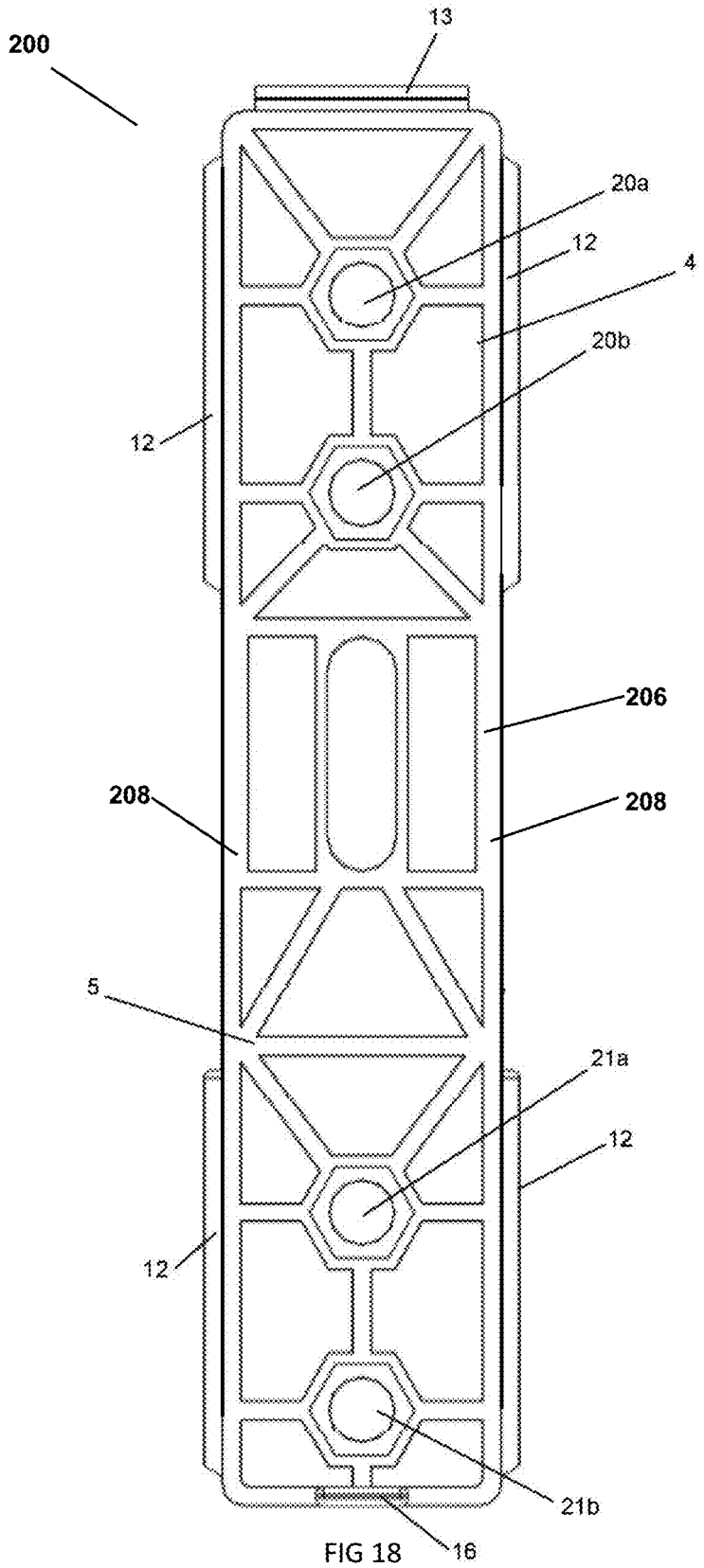
FIG. 18 is a rear view of a third embodiment of spacer piece according to the invention.
Figure 19:
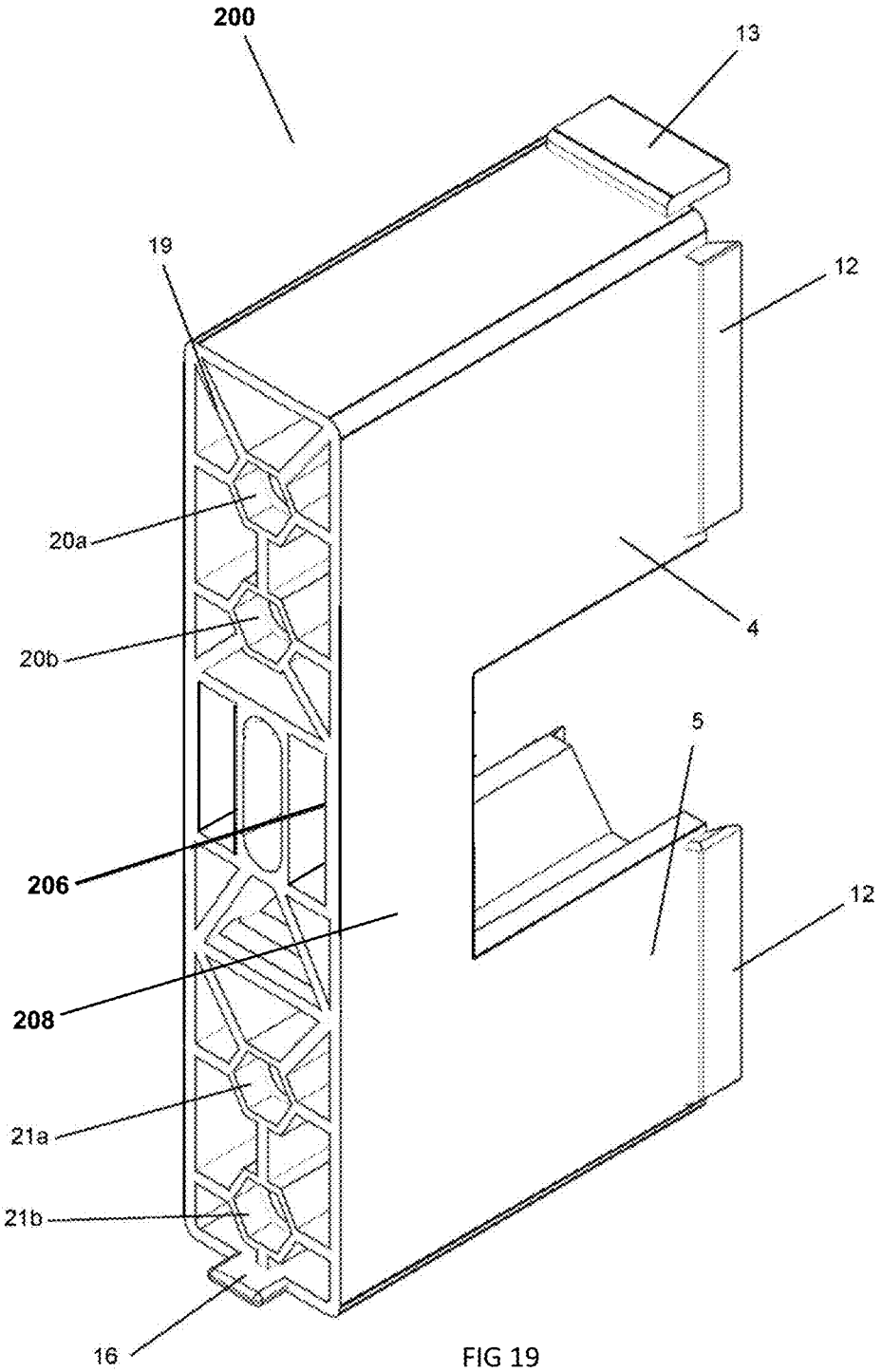
FIG. 19 is a rear perspective view of the spacer piece of FIG. 18.
Figure 20:
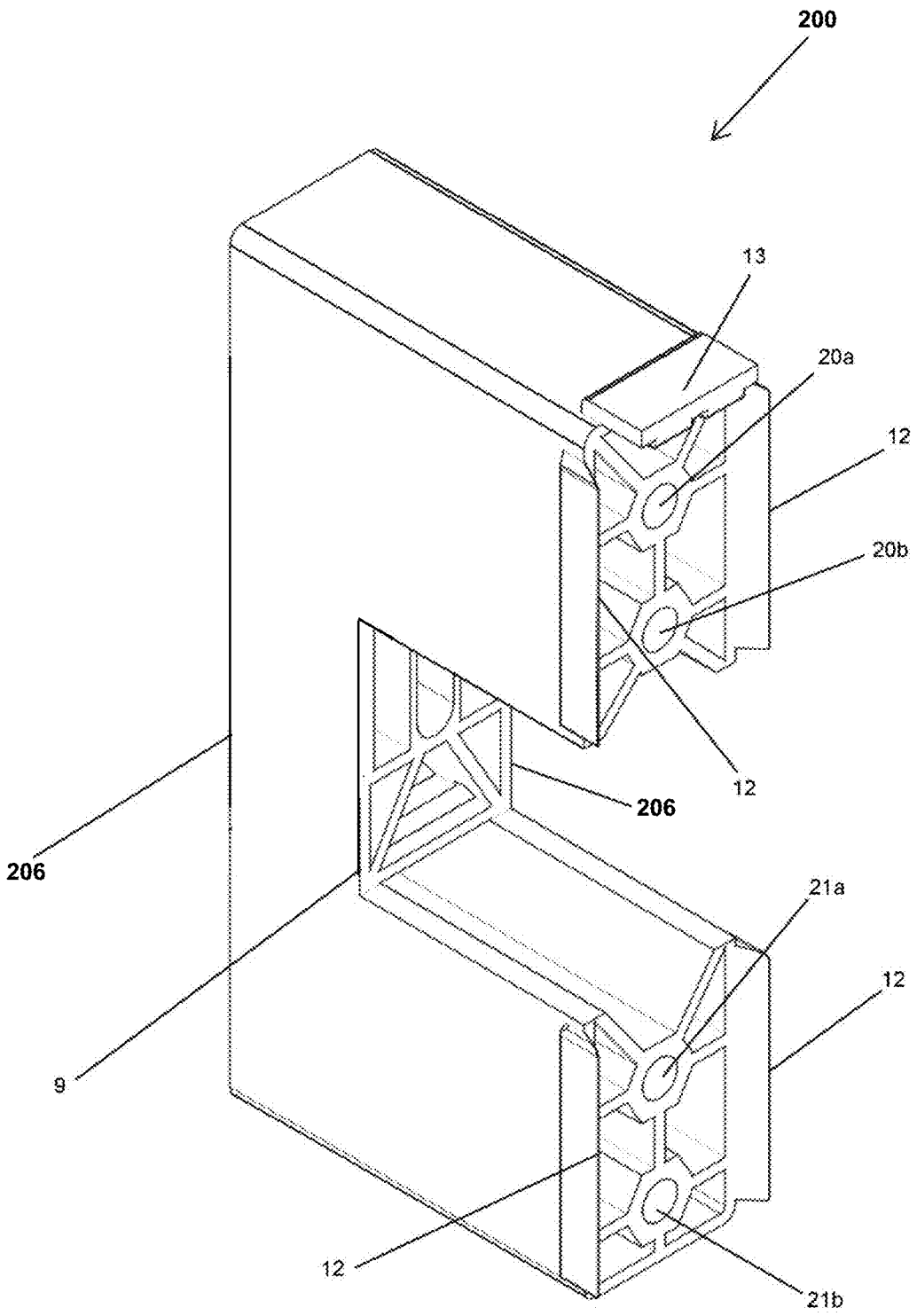
FIG. 20 is a front perspective view of the spacer piece of FIG. 18.
Figure 21:
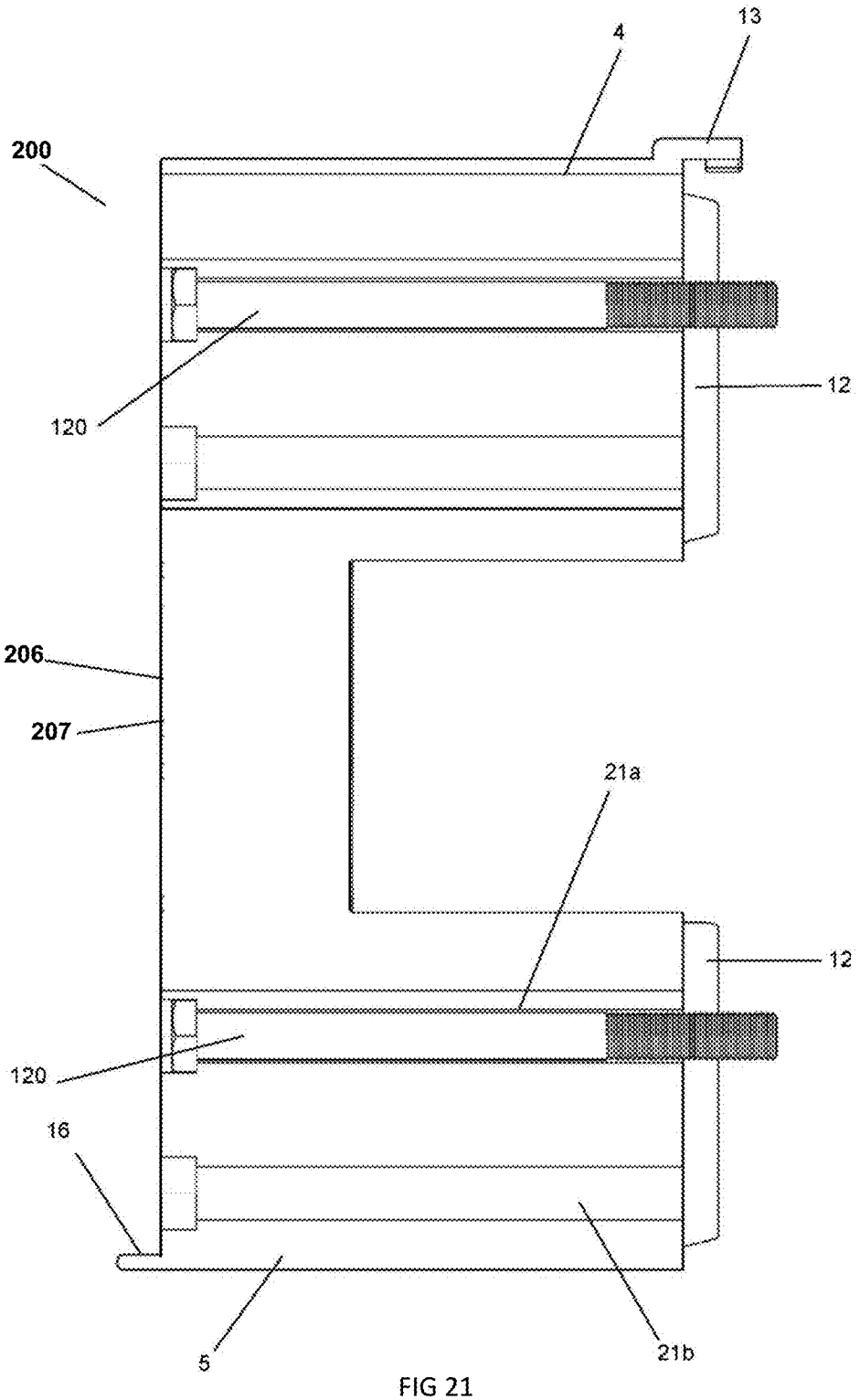
FIG. 21 is a cross-sectional right side view of the spacer piece of FIG. 18.

An example of typical installation of a guardrail system which implements spacer piece (1) is as follows. At first instance, the spacer piece (1) would typically first be positioned at the top end of a support post (3) and fastened thereto with bolts (120) that extend through spacer piece (1) (e.g. see FIG. 13) and then through appropriate openings (15) in the support post. Depending on the channels (20*a*, 20*b*, 21*a*, 21*b*) selected for the mounting bolts (120), the projecting hook portion (13) may be used to hang the spacer piece (1) from a flange (14) of the support post (3), before the bolts (120) are inserted and fastened to the support post (3). A guardrail beam (2) to be mounted is then positioned at the guard rail mounting side of the spacer piece such that a mounting bolt may be inserted therethrough and into the breakable portion (7). Where appropriate, the guard rail beam may be rested lip tab (16) during installation.

A further embodiment of the invention is shown by spacer piece (100) illustrated in FIGS. 13 to 17. The spacer piece (100) is largely the same as the embodiment as illustrated in FIGS. 1A to 12, however, it includes an additional series of apertures (10*a*) which are positioned in the narrow neck portion (6) close to the lower portion (5). The additional apertures (10*a*) further facilitate separation of the neck portion from the lower portion during an impact.

The upper and lower portions the spacer pieces as illustrated herein (1, 100) are substantially hollow with internal walls (19) that form a lattice like structure to provide strength while keeping the weight of the spacer pieces low. At the breakable portion, internal walls (19*a*) are also included but are relatively thinner and include apertures (10*b*) therein to facilitate rupturing. It will be appreciated that, in alternate forms, the upper and lower portions of the spacer pieces (1, 100) may be substantially solid.

Yet a further embodiment of the invention is shown by spacer piece (200) illustrated in FIGS. 18 to 21. In this embodiment, breakable portion (207) is provided by narrowed neck (206). Outer walls (208) of the breakable portion (207)/narrowed neck portion (206) are not substantially thinned when compared to the remainder of the spacer piece (200). There are also no apertures (e.g. 10, 10*a*) included in the outer walls (208) at the narrowed neck (206)/breakable portion (207).

The spacer pieces as described herein are typically formed of a polymer or polymer composite material, such as, for example, polypropylene or high-density polyethylene. It will be appreciated to a skilled person that other materials may also be used to form the spacer pieces, so long as a suitable rupture/breaking profile is provided by the breaking portion.

It will also be appreciated that the spacer pieces as described herein may be of a unitary construction i.e. a single part, or alternatively, may be formed of multiple parts.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A spacer piece for securement between a guardrail beam and a support post in a guardrail system, the spacer piece formed of a polymer material and configured to break during a vehicle impact, the spacer piece including an upper portion and a lower portion, wherein the upper and lower portions each include an upper and lower channel therein, the channels configured to receive fastening elements to securely mount the spacer piece to the support post such that selective positioning of fastening elements in the upper channels permits mounting of the spacer piece at a first mounting height on the support post and selective positioning of fastening elements in the lower channels permits mounting of the spacer piece at a second mounting height on the support post.

2. The spacer piece as claimed in claim 1, wherein the spacer piece includes a first breakable portion between the upper portion and the lower portion, the first breakable portion configured to break preferentially during a vehicle impact.

3. The spacer piece as claimed in claim 2, wherein the spacer piece is configured to mount the guardrail beam at the first breakable portion.

4. The spacer piece as claimed in claim 2, wherein the first breakable portion is provided as all or part of a narrowed neck between the upper portion and the lower portion.

5. The spacer piece as claimed in claim 2, wherein the spacer piece includes a guardrail mounting plane and a support post mounting plane, the first breakable portion only extending partway from the guardrail mounting plane to the support post mounting plane.

6. The spacer piece as claimed in claim 2, wherein the spacer piece includes opposing outer side walls that extend from a guardrail mounting side of the spacer piece to a support post mounting side.

7. The spacer piece as claimed in claim 6, wherein the outer walls at the first breakable portion are thinner than at the upper and lower portions of the spacer piece.

8. The spacer piece as claimed in claim 6, wherein the outer walls of the first breakable portion include apertures therein.

9. The spacer piece as claimed in claim 6, wherein, at the support post mounting side of the spacer piece, a hook portion projects from a topside of the upper portion.

10. The spacer piece as claimed in claim 2, wherein the first breakable portion includes at least one internal wall, the at least one internal wall including apertures therein.

11. The spacer piece as claimed in claim 1, wherein the upper and lower portions, at the support post mounting side of the spacer piece, include laterally extending angled guide flanges.

12. The spacer piece as claimed in claim 1, wherein, at the guardrail mounting side of the spacer piece, a lip tab projects from an underside of the lower portion.

13. A guardrail system including:

a guardrail beam;

at least one support post; and a spacer piece as claimed in claim 1.

14. A spacer piece for securing a guardrail beam to a support post in a guardrail system, the spacer piece including a breakable portion configured to break preferentially during an impact, and release the beam from the support post;

opposing outer side walls that extend from a guardrail mounting side of the spacer piece to a support post mounting side; and an upper portion and a lower portion separated by the breakable portion, and wherein the outer walls at the breakable portion are thinner than at the upper and lower portions of the spacer.

15. A spacer piece for securing a guardrail beam to a support post in a guardrail system, the spacer piece including a breakable portion configured to break preferentially during an impact, and release the beam from the support post; and opposing outer side walls that extend from a guardrail mounting side of the spacer piece to a support post mounting side; and wherein the outer walls of the breakable portion include apertures therein.

* * * * *